US008499930B2

(12) United States Patent
Parness

(10) Patent No.: US 8,499,930 B2
(45) Date of Patent: Aug. 6, 2013

(54) UNDERGARMENT HANGER

(76) Inventor: Cara Parness, Newbury Park, CA (US)

( * ) Notice: Subject to any disclaimer, the term of this patent is extended or adjusted under 35 U.S.C. 154(b) by 596 days.

(21) Appl. No.: 12/696,236

(22) Filed: Jan. 29, 2010

(65) Prior Publication Data

US 2010/0193383 A1 Aug. 5, 2010

Related U.S. Application Data

(60) Provisional application No. 61/206,603, filed on Feb. 2, 2009.

(51) Int. Cl.
*B65D 85/18* (2006.01)

(52) U.S. Cl.
USPC ..... 206/288; 383/39; 383/119; 383/22; 206/292

(58) Field of Classification Search
USPC ..... 383/22, 39, 119; 206/292, 288
See application file for complete search history.

(56) References Cited

U.S. PATENT DOCUMENTS

| | | | | | |
|---|---|---|---|---|---|
| 1,909,942 | A | * | 5/1933 | Fingerman | 206/278 |
| 2,129,857 | A | * | 9/1938 | Metzger | 248/95 |
| 2,452,096 | A | * | 10/1948 | Bertalotto | 150/140 |
| 3,139,133 | A | * | 6/1964 | Spector | 190/111 |
| 3,207,421 | A | * | 9/1965 | Hunger et al. | 229/72 |
| D300,398 | S | * | 3/1989 | Krugman | D6/514 |
| 4,850,731 | A | * | 7/1989 | Youngs | 206/308.1 |
| D332,697 | S | * | 1/1993 | Schildkraut | D3/303 |
| 5,209,344 | A | * | 5/1993 | Smith | 206/6.1 |
| D362,748 | S | * | 10/1995 | Schildkraut | D3/20 |
| 5,713,683 | A | * | 2/1998 | Bergh et al. | 402/79 |

* cited by examiner

*Primary Examiner* — Tri Mai

(57) ABSTRACT

An undergarment hanger suspending by a hanger or hook; thin and dual sided receiving pouches with side access openings for storing a wide range and sizes of undergarment clothing, accessories, and swimsuits. In addition, the shape of the undergarment hanger reduces creases and dimples formed on the stored article of clothing and the like. Fabric or other material may be provided adjacent the top, bottom and side access openings to rigidize the undergarment receiving pouches.

13 Claims, 7 Drawing Sheets

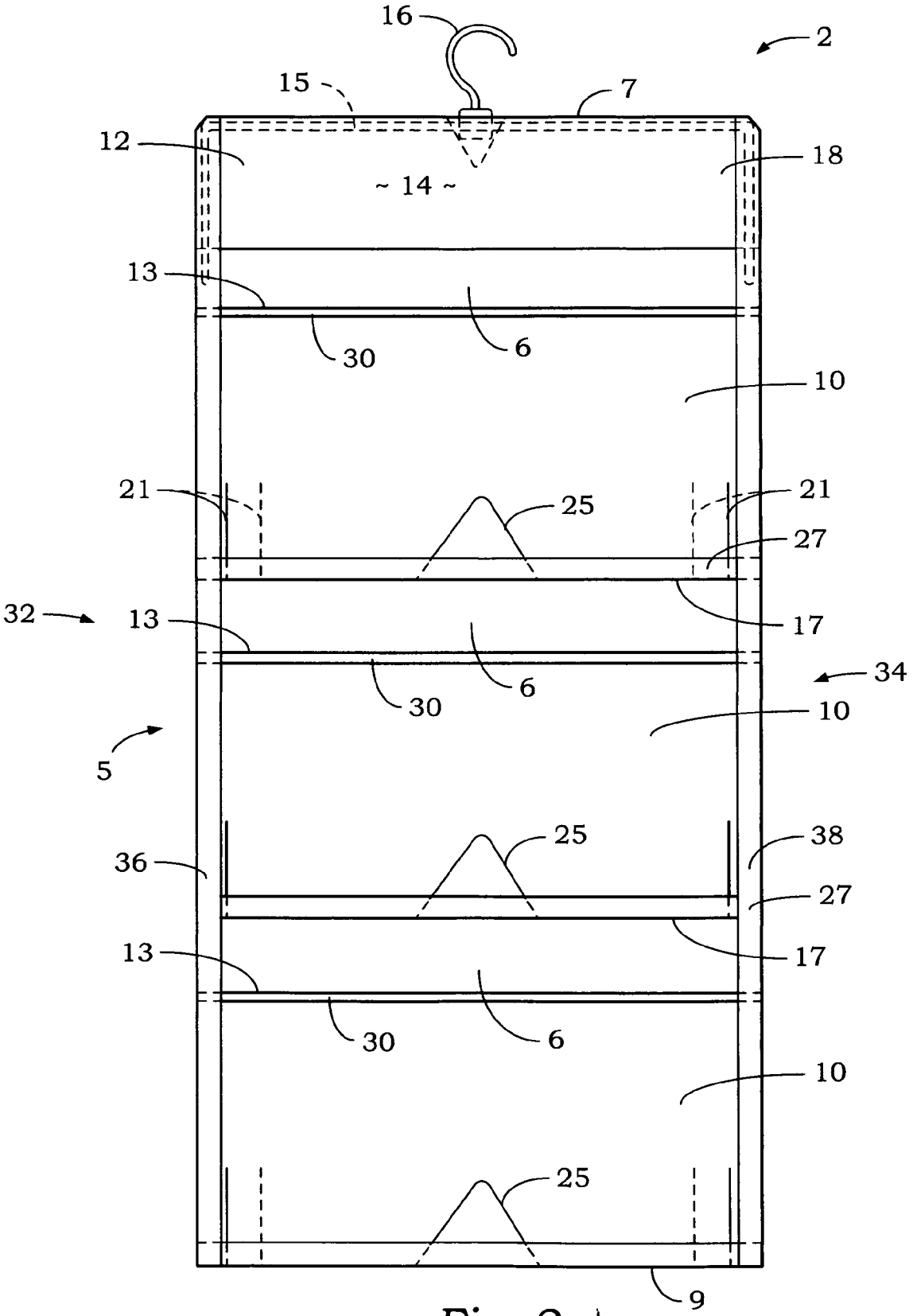
Fig. 2.1

Fig 2.2 [0015] 610
pattern back
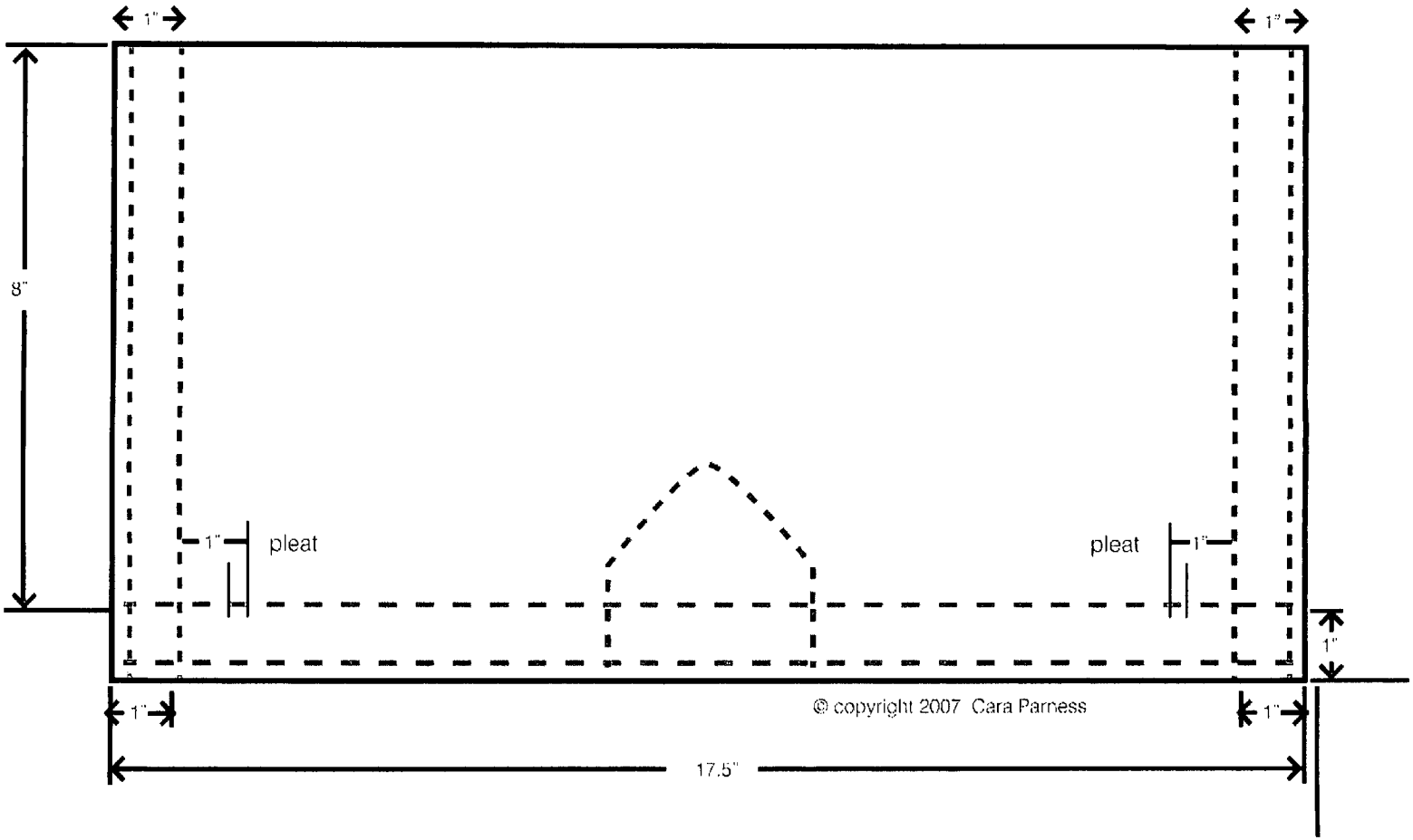

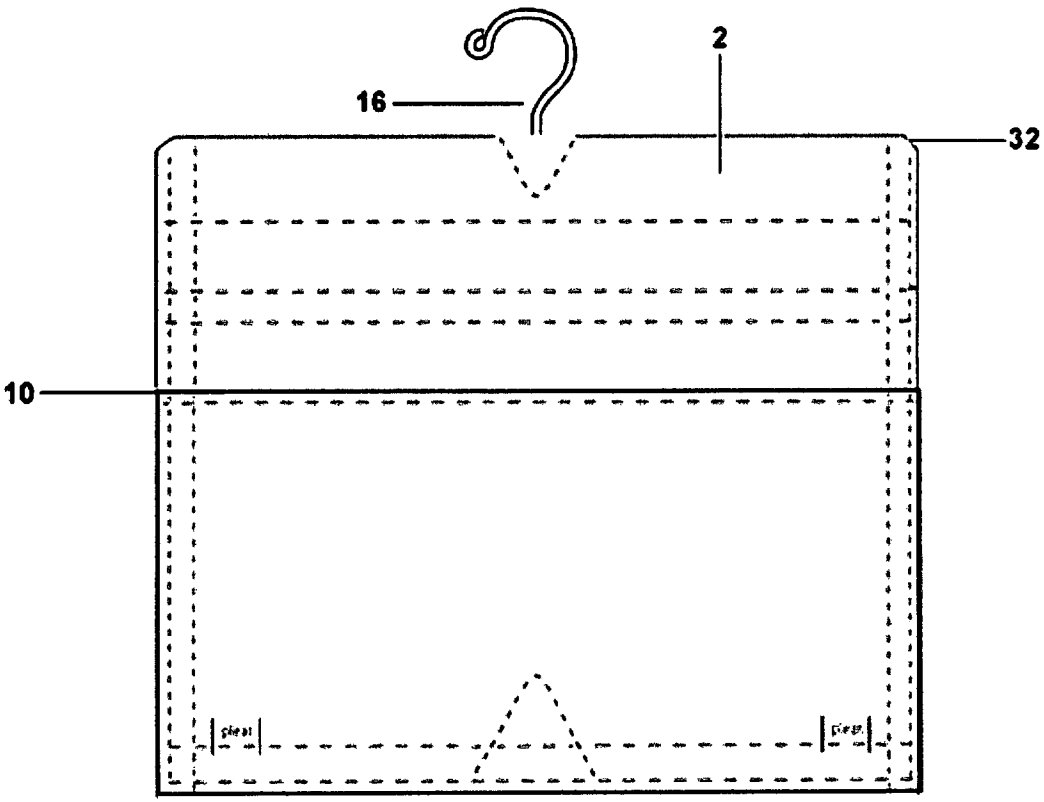
Fig 2.3
[0015] V 10

UNDERGARMENT HANGER

CROSS REFERENCE TO RELATED APPLICATION

This application claims the benefit of provisional application Ser. No. 61/206,603, filed Feb. 2, 2009.

FIELD

The present invention relates generally to a garment hanger storage and, more particularly, to an undergarment hanger for storing undergarments of numerous types in compartments, pockets, or pouches while hanging in a closet, on a hook, or a door knob and the like.

BACKGROUND

The availability of adequate storage space for personal undergarment items in the home has been a constant problem. Such items are commonly stored on a hanger, in a dresser drawer, in drawer boxes, in a laundry room, or in bathrooms. Undergarments require considerable space in a dresser drawer or other locale and are difficult to maintain in an organized state. Further, the unique storage requirements of bras to maintain their shape render typical clothing storage locations and methods ineffective.

Several methods have been developed in the past in an effort to solve the continual problem of storing such undergarments. Undergarment items have been stored in boxes, bins or other containers, and in other manners. None of the known techniques of undergarment storage like the bra box and panty box and a barrel organizer have the combined desired objective of creating additional storage space with an economical system, which can hook onto a horizontal structure, such as a closet rod, door knob, or a hook.

Known storage systems are bulky and take up valuable space where positioned and do not provide the high degree of undergarment organization and protection which is desirable. Many known storage systems inconveniently require assembly, or tools and the drilling of holes in walls or other structures for installation. These storage systems take up valuable drawer, shelf or floor space in a room. They do not allow several undergarment items to be stored hanging in a central location. Furthermore, these storage systems require rummaging through barrels, boxes, baskets or drawers to locate an undergarment item, causing undergarment and their matching sets to separate or be misplaced. For these and other reasons, it is desirable to provide an improved undergarment organizer storage system capable of effectively and economically storing and protecting personal undergarment items and the like while hanging on an existing structure.

SUMMARY

The present invention to provides an undergarment hanger having a hook and a support body, which can easily hang on a rod, door knob, or hook, or other suitable structure. In its vertical hanging position, the undergarment hanger of the present invention presents unique separate storage compartments, pockets, or pouches, which are sloped downwardly and inwardly and are accessible from either side of the undergarment hanger. Each individual storage compartment may be rigidized to provide easy access and to prevent undesired damage to undergarment items during support and storage.

The undergarment hanger of the present invention may be collapsed and folded for compact transportation and storage when not hanging on a closet rod or other like locations. Each of the compartments of the undergarment hanger neatly supports one or more undergarment items in an organized and visible manner, while hanging in a closet or on another suitable structure. The undergarment hanger may be easily hung from a built in hanger or hook that requires no tools or other fasteners for hanging. The invention is intended to store countless types of undergarments, such as, for example, personal undergarment clothing items; bras, bra pads, bra straps, bra jewelry, underwear, hosiery, socks and other like undergarments and undergarment accessories.

The undergarment hanger of the present invention is slender and takes minimal space and reduces the possibility of misplacing or losing undergarments and their coordinating undergarment accessories. It may store from small sized fitting undergarments to larger sized fitting undergarments efficiently utilizing limited closet space and the like.

DETAILED DESCRIPTION

Figure 3:
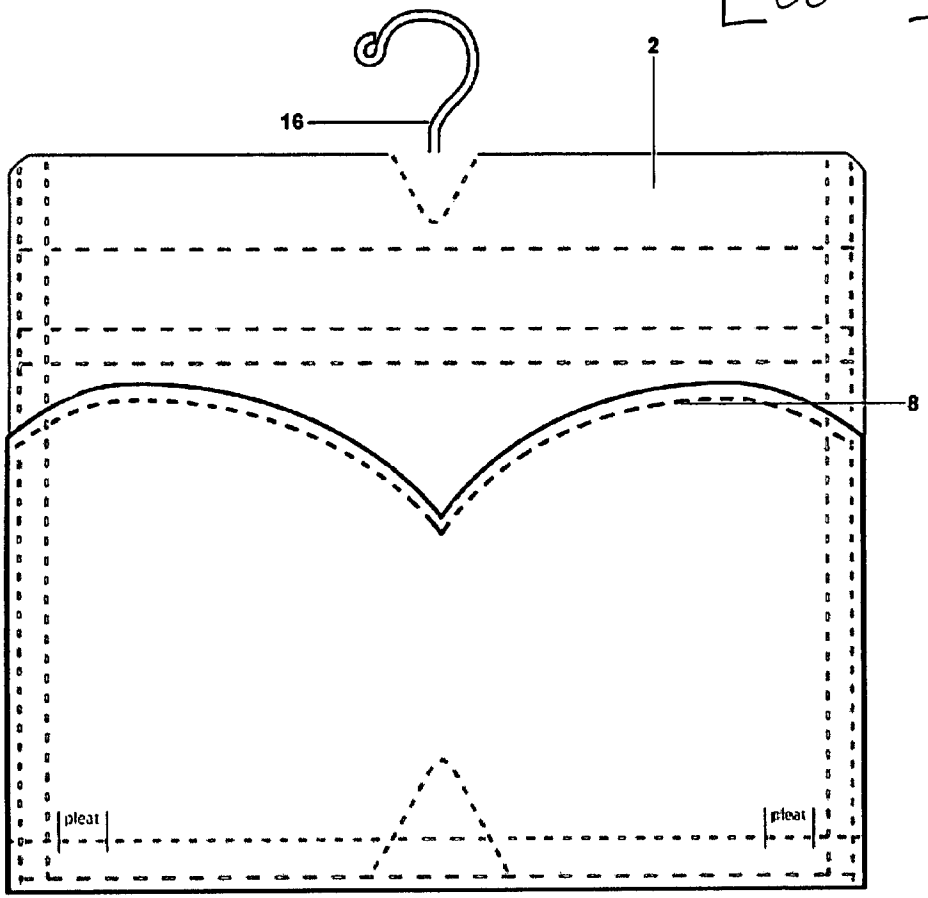
FIG. 3 is a front elevational view of the undergarment hanger of FIG. 1 in a collapsed configuration for transport and storage.
Figure 3:
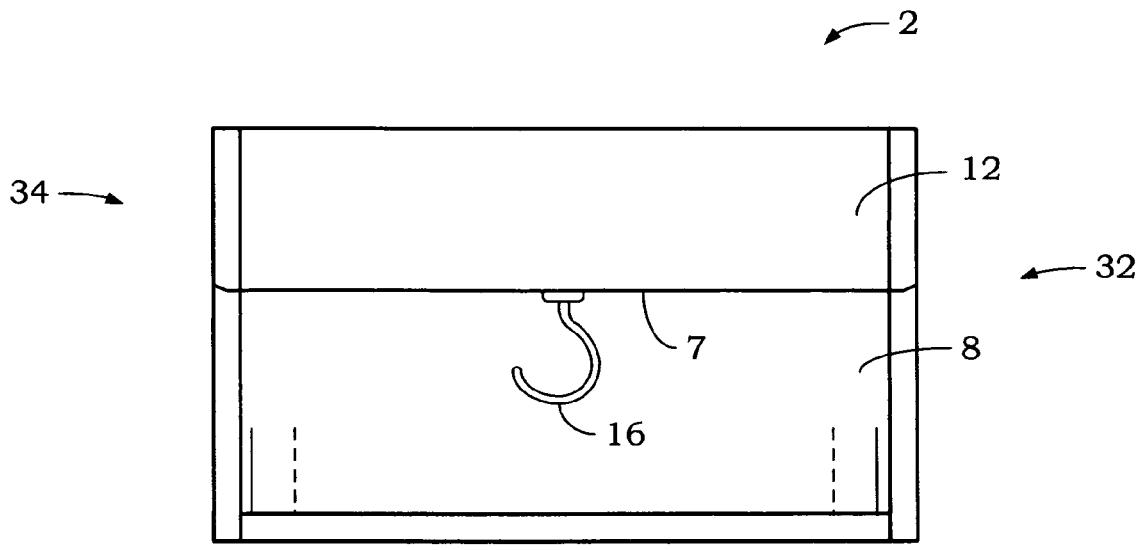
Figure 4:
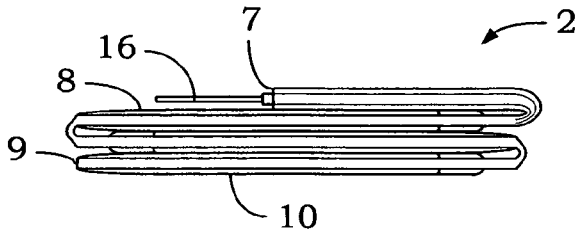
FIG. 4 is a side view of the undergarment hanger of FIG. 3.

Referring to the figures, an undergarment hanger of the present invention is generally designated by reference numeral 2, and which may be attached in hanging relationship in a closet or other structure. As will be apparent the undergarment hanger 2 is generally collapsible along its vertical axis as shown in FIGS. 3 and 4 for compact transport and storage when not in use.

Figure 1:
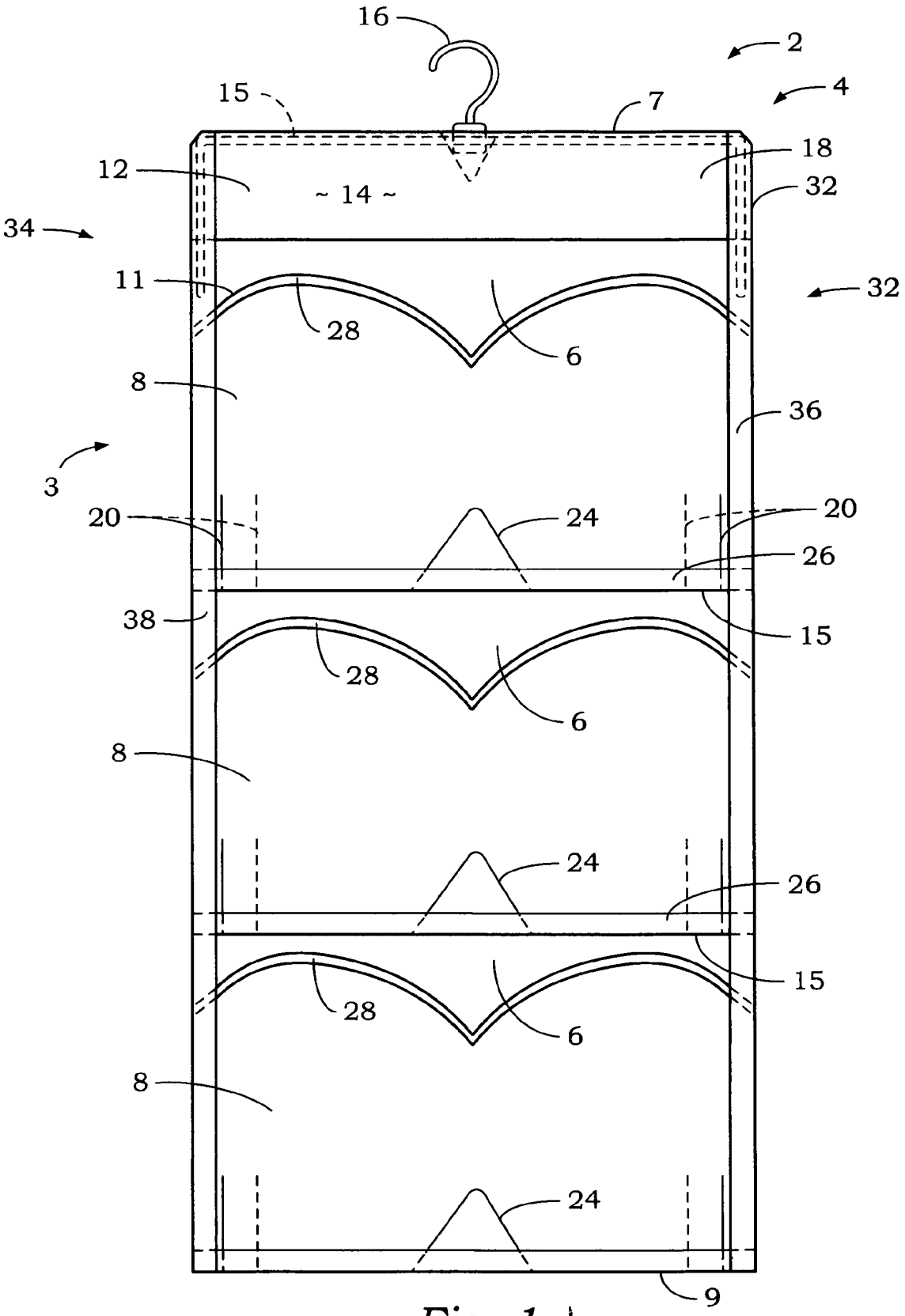
FIG. 1 is a front elevational view, of the undergarment hanger of the present invention.

Undergarment hanger 2 includes a compartment storage body 4 having a continuous base panel 6 fabricated from a suitable material, such as, for example, vinyl, duck cloth, nylon and the like. As illustrated in FIG. 1, a first side 3 of undergarment hanger 2 includes a plurality of compartments or pouches with a sweet-heart shape 8. Although three compartments 8 are illustrated, the number of compartments shown is for demonstrative purposes only and the present invention is not so limited. Other configurations of the present invention may include one or more compartments 8.

Figure 2:
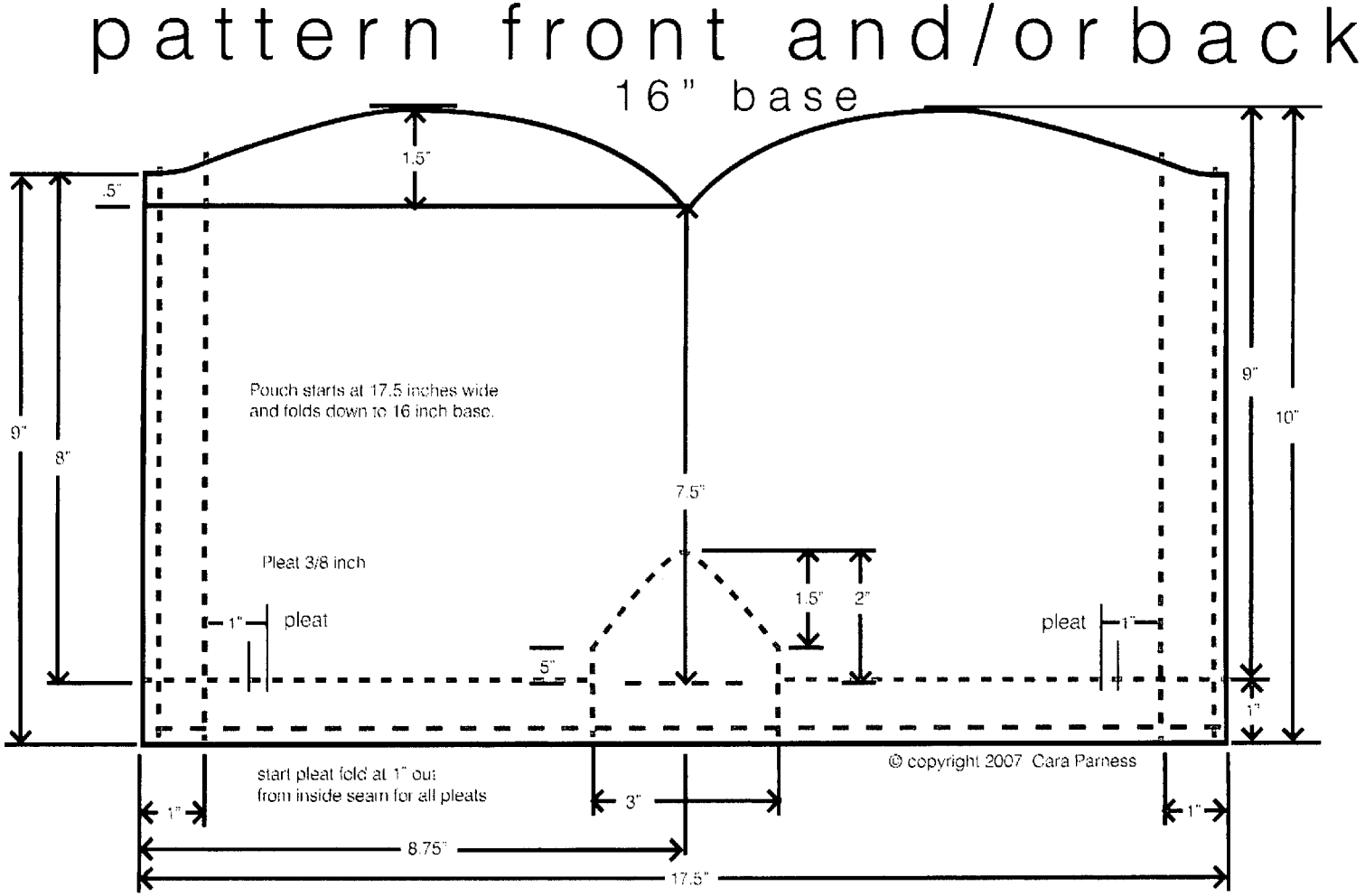
FIG. 2 is a back elevational view, of the undergarment hanger of FIG. 1.

As illustrated in FIG. 2, a second side 5 of undergarment hanger 2 includes a plurality of compartments or pouches with a rectangular shape 10. Although three compartments 10 are illustrated, the number of compartments shown is for demonstrative purposes only and the present invention is not so limited. Other configurations of the present invention may include one or more compartments 10. Further, the undergarment hanger 2 may include only sweet-heart shaped compartments 8 on both sides 3 and 5.

Each side of the compartments or pouches 8 and 10 is separated from an adjacent compartment or pouch respectively by the base panel 6. Each compartment panel 8 and 10 opens at the top and slopes downwardly and inwardly from each edge or side of storage body 4. The sweet-heart shape compartments or pouches 8 and rectangular shape compartment or pouches 10 may be stitched, heat sealed, bonded or otherwise affixed to the base panel 6. These methods rigidize the compartments or pouches 8 and 10 and generally maintaining the shape of each of the compartments or pouches 8 and 10, therefore creating compartment storage body 4. The base panel 6 may extend from the top edge 7 to the bottom edge 9 of the undergarment hanger 2 or may present a frame with an open center area to allow access from either side 3 or 5 from one compartment 8 to the opposite compartment 10.

An upper most compartment panel 12 may be covered by an additional layer of fabric 14, such as nylon, duck cloth, or poplin and the like wrapping over the top edge 7 of the body 4 and the top of the base panel 6. The additional layer of fabric 14 wrapping around the uppermost compartment panels 12 and may be stitched or heat sealed or utilize a like method to be affixed to the base panel 6. Upper compartment panels 12 provide additional strength and rigidity to the undergarment hanger 2 and conceal horizontal members 15 which are secured to a hanger or hook 16. The horizontal members 15 and hook 16 may be fabricated from steel, heavy plastic or other suitable material to provide support for the undergarment hanger 2. The horizontal members 15 and hook 16 may be fabricated from a single piece of rigid wire or other structural material or hook 16 may be pivotally secured to the horizontal members 15 to allow the undergarment hanger 2 to be pivoted while the hook 16 is hooked over a rod in a closet, for example.

The uppermost compartment panels 12 and additional layer of fabric 14 may be reinforced with an additional layer of fabric material 18, such as nylon, duck cloth, or the like, which may be finished by horizontally wrapping around the bottom edges of the additional layer of fabric 14 and affixed to the base panel 6. The additional fabric layer 18 further stiffens the compartment storage body 4 above the upper most compartment panels 12.

Each compartment or pouch 8 and 10 includes a pleat 20 and 21 respectively along left and right edges 22. The pleats 20 and 21 allow the compartments 8 and 10 respectively to expand as necessary to hold an undergarment or accessory. Further, the pleat 20 along the lower edge of the compartments 8 and 10 tends to keep the compartments 8 and 10 open at the upper edges 11 and 13 respectively.

The compartment panels 8 and 10 are reinforced along the bottom edges 15 and 17 respectively in the center with inverted V-shaped panels 24 and 25 respectively which are stitched, or bonded to the compartment panels 8 and 10 respectively through the base panel 6. The inverted V-shaped panels 24 and 25 may be constructed of a fabric material, such as, for example, vinyl, duck cloth, nylon and the like. The bottom edges 15 and 17 of compartments 8 and 10 are reinforced with an additional layer of fabric material 26 and 27 respectively, such as nylon, duck cloth, or the like, horizontally wrapping around the bottom edges 15 and 17 of the compartments or pouches 8 and 10 and is affixed to the base panel 6.

The upper horizontal edges 11 and 13 compartment panels 8 and 10 may be stiffened by an additional layer of fabric material 28 and 30 respectively, such as nylon, duck cloth, or the like, which is wrapped over the edges 11 and 13 and stitched, bonded, or otherwise secured to the compartment panels 8 and 10.

The undergarment hanger 2 is reinforced along vertical edges 32 and 34 with a fabric material 36 and 38, such as nylon, duck cloth, or the like, vertically wrapping around the outer edge portions 32 and 34 of the undergarment hanger 2.

Referring to FIGS. 3 and 4, the undergarment hanger 2 is shown in a collapsed configuration for economy of space for transport, packaging and storage. Such an effective collapse is attained because of the flexible material of base panel 6, compartments 8 and 10 and the geometric arrangement of the compartments 8 and 10 and the hanger 16.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. An undergarment hanger comprising:

a body having a base panel, a top edge, a bottom edge, left and right vertical edges, front and back sides, a hook secured to said top edge of said body, a first pouch having a free sweet-heart shaped upper edge with a V-shaped depression portion, said V-shaped depression portion having a vertex, a bottom horizontal edge secured to said base panel on said front side of said body, a left vertical edge secured to said base panel on said front side of said body and a right vertical edge secured to said base panel on said front side of said body, a generally inverted V-shaped panel extending upwardly from said bottom horizontal edge of said first pouch generally centered between said left and right vertical edges of said first pouch and secured to said first pouch, said inverted V-shaped panel having a vertex, said vertex of said V-shaped depression generally aligning with said vertex of said inverted V-shaped panel along a longitudinal line a second pouch having a generally rectangular shape, a free upper edge, a bottom horizontal edge secured to said base panel on said back side of said body, a left vertical edge secured to said base panel on said back side of said body and a right vertical edge secured to said base panel on said back side of said body, and a horizontal structural member coupled to said hook along said top edge of said body, whereas said undergarment hanger may be supported in a hanging position from said hook, whereas said first pouch presents an open container on said front side of said body, wherein said second pouch presents an open container on said back side of said body, and whereas said undergarment hanger may be folded to present a storage configuration.

2. The undergarment hanger of claim 1 further comprising a generally inverted V-shaped panel extending upwardly from said bottom horizontal edge of said second pouch generally centered between said left and right vertical edges of said second pouch and secured to said second pouch.

3. The undergarment hanger of claim 1 further comprising two or more first pouches secured to said base panel on said front side of said body in vertical alignment and two or more second pouches secured to said base panel on said back side of said body in vertical alignment.

4. The undergarment hanger of claim 1 wherein said base panel includes an opening from said first pouch to said second pouch.

5. The undergarment hanger of claim 1 wherein said hook is pivotally coupled to said horizontal structural member.

6. The undergarment hanger of claim 1 further comprising an upper most compartment panel wrapped over said top edge of said body.

7. The undergarment hanger of claim 1 further comprising a fabric material wrapped over and secured to said free sweet-heart shaped upper edge of said first pouch.

8. The undergarment hanger of claim 1 further comprising a fabric material wrapped over and secured to said free upper edge of said second pouch.

9. The undergarment hanger of claim 1 wherein said first pouch includes a first pleat extending from said bottom horizontal edge of said first pouch proximal said left vertical edge of said first pouch and a second pleat extending from said bottom horizontal edge of said first pouch proximal said right vertical edge of said first pouch.

10. The undergarment hanger of claim 1 wherein said second pouch includes a first pleat extending from said bottom horizontal edge of said second pouch proximal said left vertical edge of said second pouch and a second pleat extending from said bottom horizontal edge of said second pouch proximal said right vertical edge of said second pouch.

11. The undergarment hanger of claim 1 further comprising a reinforcing material secured along said bottom horizontal edge of said first pouch.

12. The undergarment hanger of claim 1 further comprising a reinforcing material secured along said bottom horizontal edge of said second pouch.

13. The undergarment hanger of claim 1 further comprising a first reinforcing material wrapped around said left vertical edge of said body from said front side to said back side of said body and a second reinforcing material wrapped around said right vertical edge of said body from said front side to said back side of said body.

* * * * *